US007654428B2

(12) United States Patent
Behmel et al.

(10) Patent No.: US 7,654,428 B2
(45) Date of Patent: Feb. 2, 2010

(54) TURNER BAR FOR ROTARY PRESSES

(75) Inventors: Johannes Behmel, Plauen (DE); Andrea Schädlich, Leubnitz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 41 days.

(21) Appl. No.: 11/728,087

(22) Filed: Mar. 23, 2007

(65) Prior Publication Data

US 2007/0267535 A1 Nov. 22, 2007

(30) Foreign Application Priority Data

Mar. 24, 2006 (DE) ..... 10 2006 013 659

(51) Int. Cl.
*B65H 20/00* (2006.01)

(52) U.S. Cl. ..... 226/97.3; 226/196.1; 242/615.12

(58) Field of Classification Search ..... 226/97.1, 226/97.3, 196.1; 242/615.1, 615.12, 615.2, 242/615.21, 548

See application file for complete search history.

(56) References Cited

U.S. PATENT DOCUMENTS

| | | | | |
|---|---|---|---|---|
| 5,233,919 A | | 8/1993 | Fecteau et al. | |
| 5,316,199 A | * | 5/1994 | Hansen et al. | 242/615.12 |
| 5,464,143 A | * | 11/1995 | Hansen | 242/615.12 |
| 5,520,317 A | | 5/1996 | Eckert et al. | |
| 6,427,941 B1 | * | 8/2002 | Hikita | 242/615.12 |
| 6,786,449 B2 | * | 9/2004 | Marcle-Geler et al. | 242/615.12 |
| 6,796,524 B2 | * | 9/2004 | Pollock et al. | 242/615.12 |
| 7,100,864 B2 | * | 9/2006 | Weis | 242/615.12 |
| 7,275,709 B2 | * | 10/2007 | Weis | 242/615.12 |
| 7,311,234 B2 | * | 12/2007 | Solberg | 226/97.3 |
| 2004/0149855 A1 | * | 8/2004 | Weis | 242/615.21 |

FOREIGN PATENT DOCUMENTS

| | | |
|---|---|---|
| DE | 29 20 701 | 4/1981 |
| DE | 34 36 870 | 5/1986 |
| GB | 621170 | 4/1949 |

OTHER PUBLICATIONS

Search Report dated Mar. 24, 2006 issued for the corresponding German Application No. 10 2006 013 659.4.

* cited by examiner

*Primary Examiner*—John Q Nguyen
*Assistant Examiner*—William E Dondero
(74) *Attorney, Agent, or Firm*—Cohen Pontani Lieberman & Pavane LLP

(57) ABSTRACT

A turner bar for a rotary press for deflecting a substrate web in two web running directions is acted upon by pressurized air. The turner bar includes at least one inner tube and one outer tube, which have air discharge holes assigned to one another to produce an air cushion above the turner bar. The inner tube can be adjusted relative to the outer tube, so that the air discharge holes can be closed in such a way that the air cushion is adapted to the margins of the substrate web. It is thus possible to use the turner bar in both web running directions.

8 Claims, 6 Drawing Sheets

TURNER BAR FOR ROTARY PRESSES

BACKGROUND OF THE INVENTION

1. Field of the Invention

The present invention concerns a turner bar for rotary presses and especially a reversible turner bar for use in two web running directions.

2. Description of the Related Art

The running direction of a substrate web, such as a web of paper, is changed in a rotary press by means of a turner bar. The turner bar is acted upon with compressed air and forms an air cushion at least in some sections of its outer peripheral surface, so that the substrate web does not come into direct contact with the turner bar. This provides several advantages. The friction that arises during the deflection of the substrate web is reduced by the air cushion. The deposition of printing ink on the turner bar is avoided. The printing on the still wet substrate web is not smeared by the turner bar during the deflection of the substrate web. Depending on the printing run, it may be necessary to change the running direction of the substrate web. For example, it may be necessary to deflect a substrate web for one printing run to the right of the web running direction by an angle of, e.g., 90°, and to the left by 90° in another printing run.

To meet these requirements, so-called "flying" turner bars are used in the prior art. For this purpose, the turner bar is detachably mounted in a holder, and a specially manufactured turner bar is necessary for each desired web running direction. In other words, it is necessary to change over from one turner bar to another turner bar that is kept in stock.

Aside from the fact that a separate turner bar must therefore be produced for each web running direction, this solution means increased logistical expense for printing press operators, since turner bars must be stored in the printing plant.

German Patent DE 34 36 870 C1 deals with the aforementioned disadvantages. The early disclosure document discloses a rotatably supported turner bar, in which two pistons, whose geometry corresponds to the edge of the web of paper guided around the outside of the turner bar, are mounted inside the turner bar and are axially displaced by two spindles to close the holes that are not needed in the turner bar.

The design shown in DE 34 36 870 C1 is not very flexible with respect to the web widths to be processed and has fluid-dynamic disadvantages in the formation of the air cushion on the turner bar.

SUMMARY OF THE INVENTION

An object of the present invention is to produce a turner bar which has an alternative mechanism for a variable web width with fluid-dynamically improved air cushion formation.

The invention is based on a turner bar for a rotary press for deflecting a substrate web in several web running directions. The turner bar has an outer tube that contains at least one inner tube. The turner bar is acted upon by pressurized air flowing from the inside to the outside, so that an air cushion is formed on the outer peripheral surface of the turner bar by means of air discharge holes located in both the inner tube and the outer tube.

The air discharge holes in the inner tube and in the outer tube are adjusted relative to one another in such a way that a common air discharge opening of the turner bar is formed by adjusting either the inner tube relative to the outer tube or the outer tube relative to the inner tube. The adjustment of the individual air discharge holes of the tubes relative to one another makes it possible to realize a finer and fluid-dynamically more effective adaptation of the turner bar to changes in web width. In addition, the air discharge holes can be adjusted in such a way that the turner bar can be reversed to change the web running direction, and then the air discharge holes can be adjusted to the changed web running direction. In other words, after the web running direction has been changed and the turner bar has been reversed, air discharge holes that are not needed are closed by adjusting the air discharge holes relative to one another, so that the resulting air cushion is also adapted to the changed course of the margins of the substrate web on the turner bar.

In one embodiment of the invention, the outer tube and the inner tube can be rotated relative to each other and/or axially adjusted relative to each other. Basically any conceivable mechanism can be used to adjust the air discharge holes of the outer tube and the inner tube, as long as suitable closure of the air discharge holes that are not needed is made possible. In regard to the realization of the invention, it is unimportant whether the outer tube can be adjusted relative to the inner tube, or the inner tube can be adjusted relative to the outer tube, or both tubes can be adjusted.

In an advantageous refinement of the invention, holes are formed in the outer tube, and slots are formed in the inner tube in the circumferential direction. Closure of the unneeded air discharge holes that is adapted to the given position of the turner bars is possible by the assignment of slots in the inner tube and holes in the outer tube and of an adjusting direction of the inner tube relative to the outer tube that corresponds to the position of the turner bar. For example, the use of the same turner bar for two web running directions is possible, so that only a single turner bar for both web running directions is needed in the printing plant.

In another refinement of the invention, the slots in the inner tube are longer towards the middle of the turner bar. The variably long slots guarantee that, in the case of rotating adjustment of the inner tube relative to the outer tube, the air discharge holes can be adapted to the width of the substrate web. In other words, when the inner tube is adjusted by rotation, first the air discharge holes on the outside of the turner bar are closed, and the air discharge holes located towards the middle are closed only after further rotation in the same direction of rotation.

In another refinement of the invention, the inner tube can be adjusted relative to the outer tube in such a way that the discharge of air is prevented on an outer section of a single end of the turner bar. This is ensured by displacing the inner tube axially relative to the outer tube. The slots in this embodiment are made wider than the diameters of the holes in the outer tube. The holes are assigned to the slots in such a way that when the inner tube is axially displaced, the air discharge holes of an outer section of the turner bar are closed. Furthermore, it is possible to divide the inner tube in such a way that two inner tubes are present, and only one of the tubes is axially displaced. In this embodiment, the width of the slots can be the same in all of the inner tubes. In this way, when an inner tube is axially displaced, the air discharge holes in the region of the turner bar above this inner tube are completely closed. The closure of the air discharge holes of an outer section, e.g., half of the turner bar, allows production with a half-width web located on the inside or outside.

In another advantageous refinement of the invention, a holder that allows fast and convenient reversing of the turner bar according to the web running direction is provided, and adjusting drives facilitate or automate the reversing of the turner bar. In addition, another adjusting drive can be provided for adjusting the tubes relative to each other.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figures 1, 2, 3:
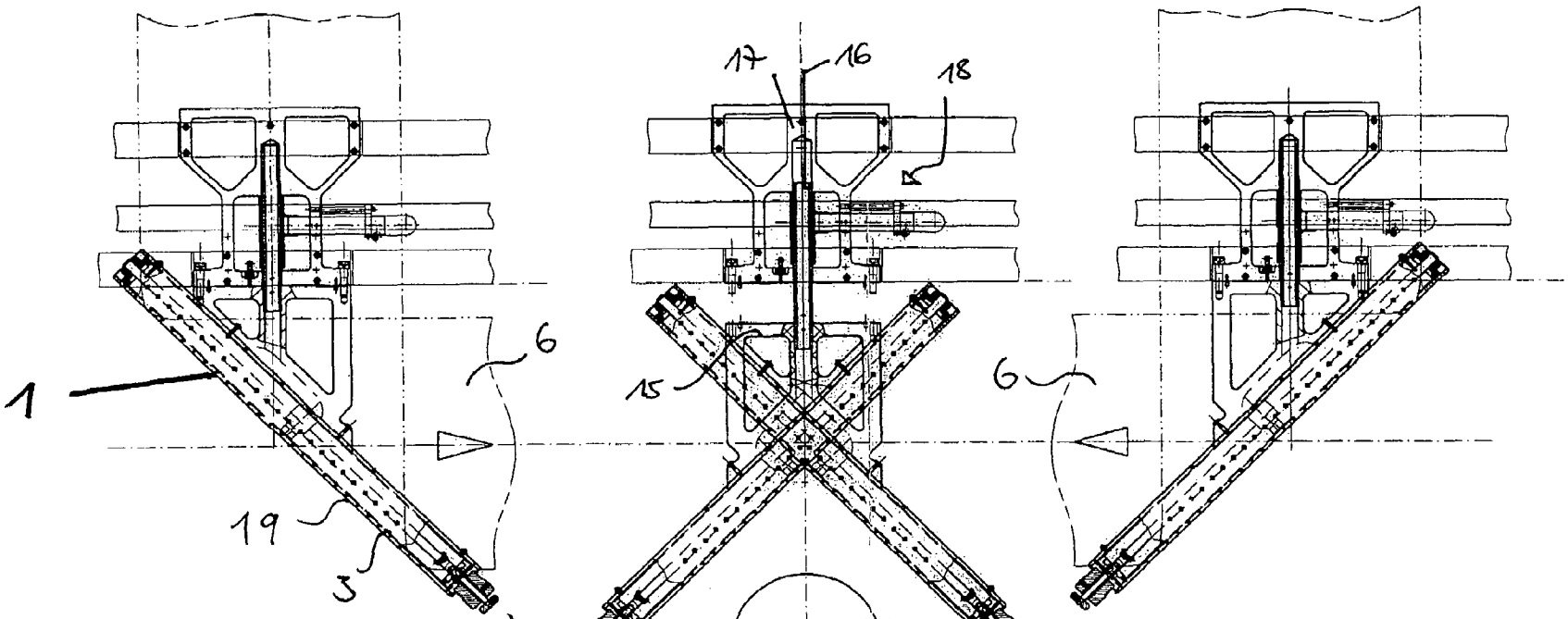
FIG. 1 shows a cross-sectional view of the position of the turner bar for deflecting the substrate web to the right.
FIG. 2 is a cross-sectional drawing that illustrates the operation of reversing the turner bar.
FIG. 3 shows a cross-sectional view of the position of the turner bar for deflecting the substrate web to the left.

FIG. 1 shows a turner bar 1 that deflects the substrate web to the right. An adjusting mechanism is mounted at the end of the turner bar and is used for rotational and axial adjustment of the inner tube 3 relative to the outer tube 19. As FIG. 2 shows, the turner bar can be reversed to allow production in the opposite web running direction. This is accomplished by detaching a first part 15 of the holder 18 from a second part 17 by unscrewing corresponding fastening bolts that join the parts 15, 17 of the holder 18. After they have been separated, the first part 15 of the holder 18 and the second part 17 of the holder 18 remain connected with each other by a shaft 16. The position of the shaft 16 is selected in such a way that the turner bar can be turned in a way that no center offset of the paper web 6 occurs after its deflection. Air is supplied to the turner bar 1 through the shaft 16 in such a way that no additional parts for reversing the turner bar must be reconnected. FIG. 3 shows the turner bar in a position for production with a paper web 6 deflected to the left.

Figure 4:
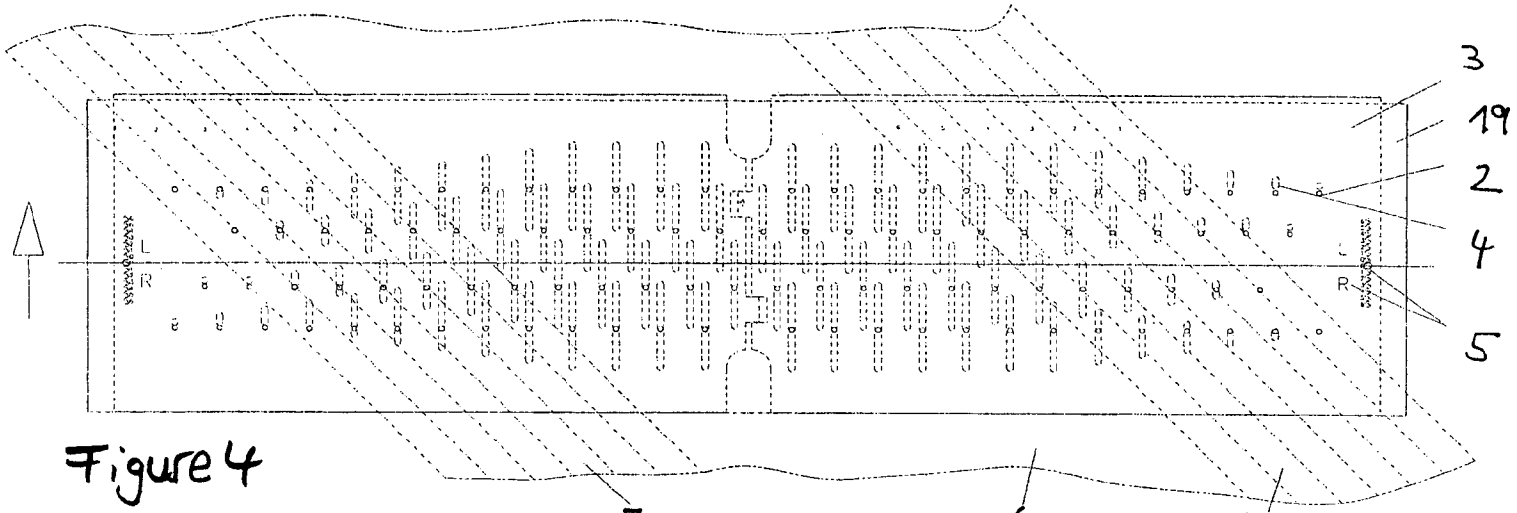
FIG. 4 shows the arrangement of the turner bar of a first embodiment with an inner and outer tube.
Figure 5:
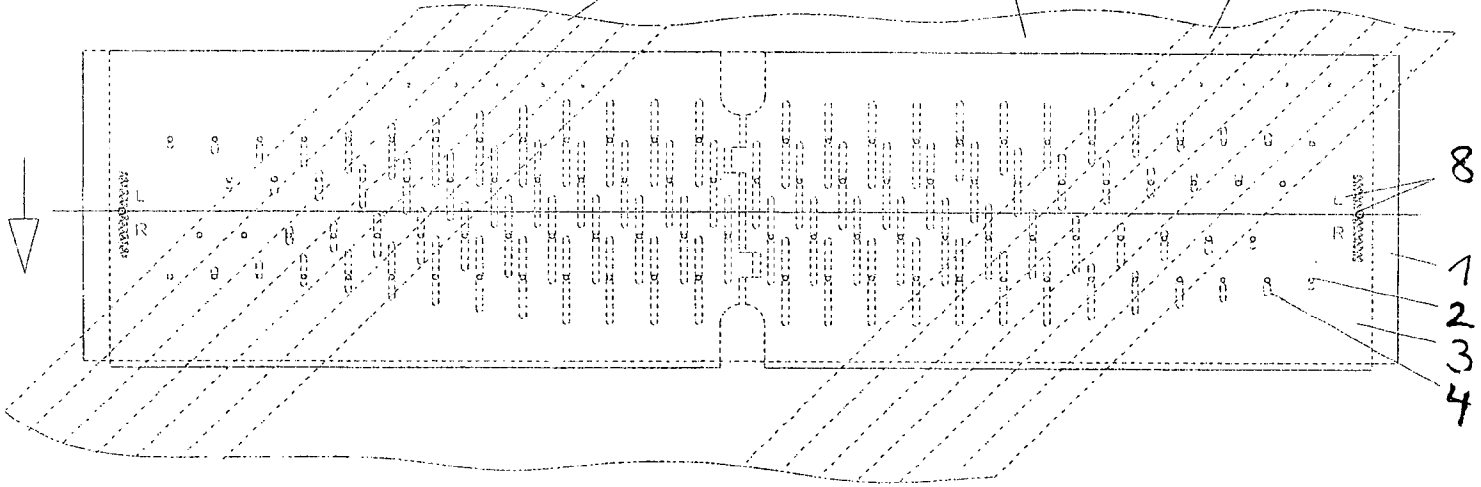
FIG. 5 shows the arrangement of the turner bar of a first embodiment with an inner and outer tube, adjusted for a different web running direction compared to FIG. 4, FIGS. 6 and 7 show the arrangement of the turner bar of a first embodiment with the example of adjustment for a narrow substrate web.

FIG. 4 shows the arrangement of an outer tube 19 and an arrangement below it of the inner tube 3. Holes 2 are made in the outer tube 19, and each hole 2 is associated with a corresponding slot 4 in the inner tube. For a maximum paper web width to be processed, all of the air discharge holes 2, 4 for a selected web running direction are open. To this end, the two tubes are in the position "R0" 5, which is indicated on the turner bar by means of a suitable scale. The reference numbers 7 show the width ranges of the turner bar that can be assigned. The width can be increased or decreased to adjust to a corresponding paper web 6. FIG. 5 shows a view that corresponds to FIG. 4 but with the web running direction to the left, i.e., here the position "L0" 8 of the turner bar is set, so that the air discharge holes corresponding to the margins of the paper web 6 are closed.

Figure 6:
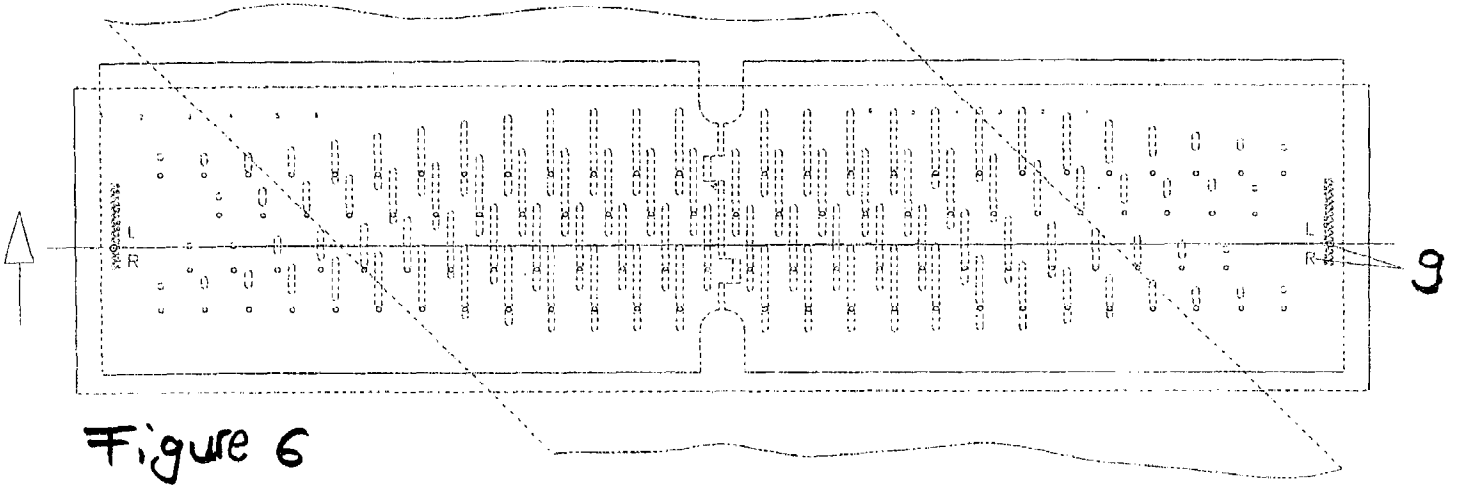
Figure 7:
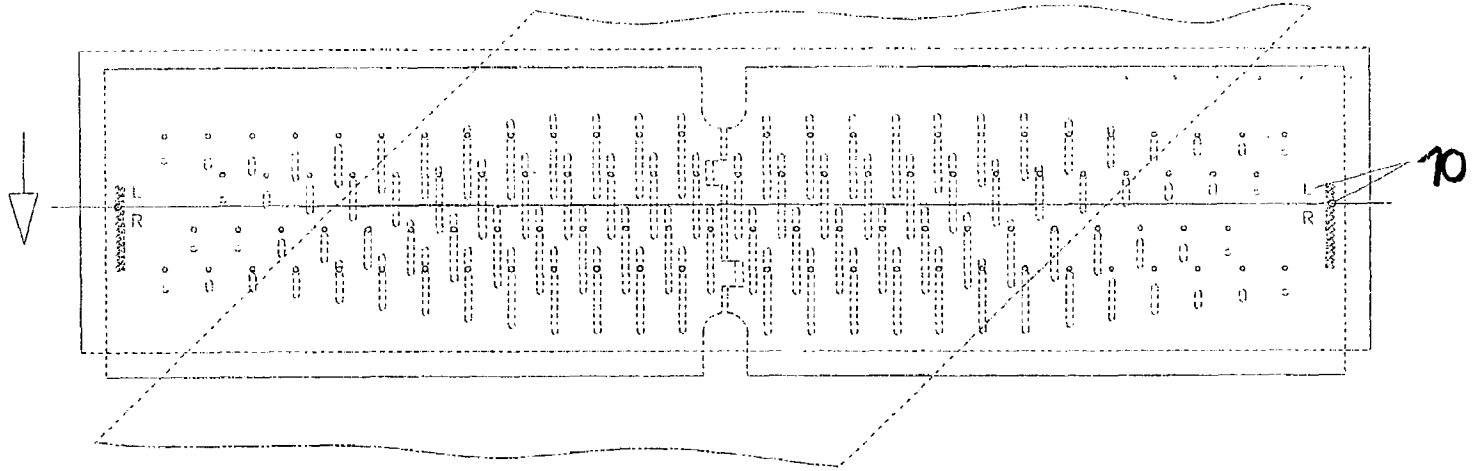

FIGS. 6 and 7 show as examples the settings "R3" 9 and "L3" 10, respectively, for a relatively narrow substrate web.

Figure 8:
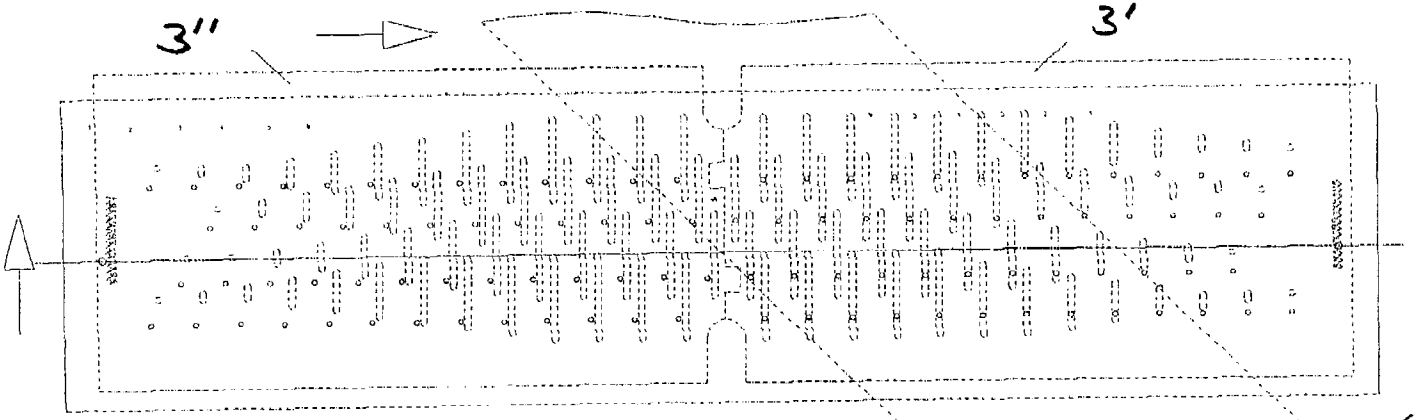
FIG. 8 shows the arrangement of the turner bar of a second embodiment with a first, axially displaced inner tube for production with a half-width web.
Figure 9:
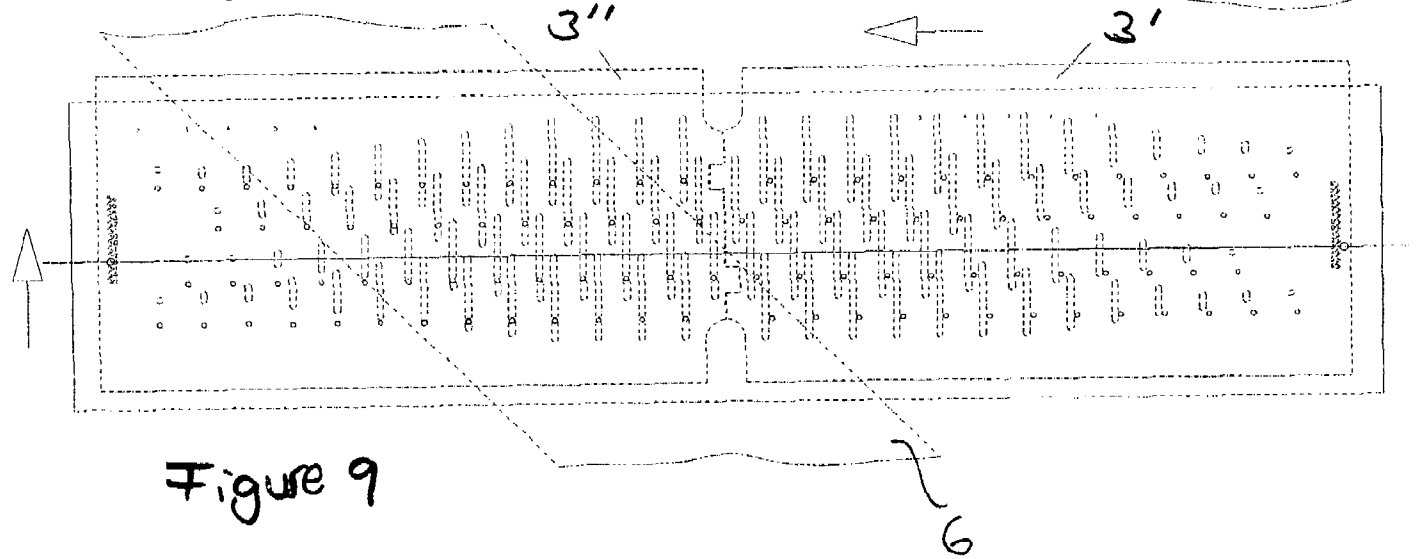
FIG. 9 shows the arrangement of the turner bar of a second embodiment with a second, axially displaced inner tube for production with a half-width web on the opposite side of the turner bar relative to FIG. 8.

FIGS. 8 and 9 show another embodiment of the invention, which has two inner tubes 3' and 3". The use of two inner tubes serves the purpose of closing the air discharge holes 2, 4 of one half of the turner bar, so that production can be carried out with a half web. All holes 2 of the outer tube 19 are closed by an axially displaced inner tube 3' or 3", independently of the radial position of the inner tube.

Figure 11:
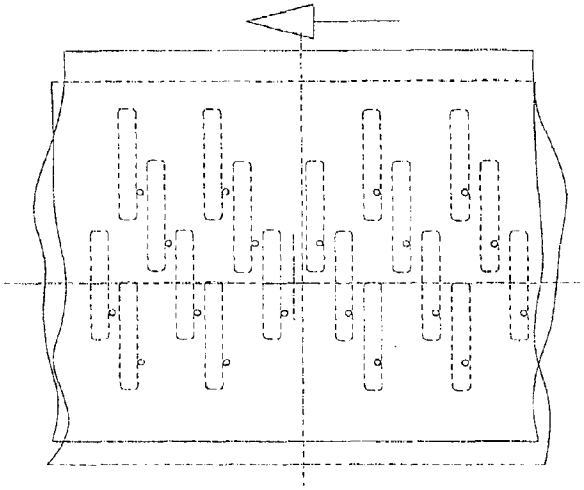
FIG. 11 shows the arrangement of the turner bar of a third embodiment, where the air discharge holes of the left side are closed.
Figure 12:
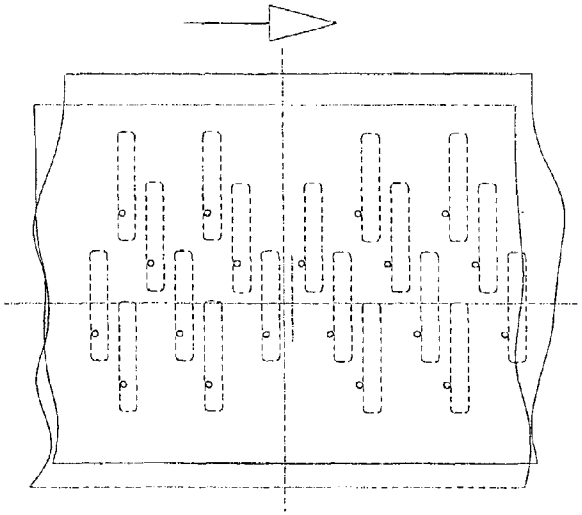
FIG. 12 shows the arrangement of the turner bar of a third embodiment, where the air discharge holes of the right side are closed, and FIGS. 13A. 13B, and 13C, illustrate an adjusting mechanism for the rotary and axial adjustment of the inner tube.
Figure 10:
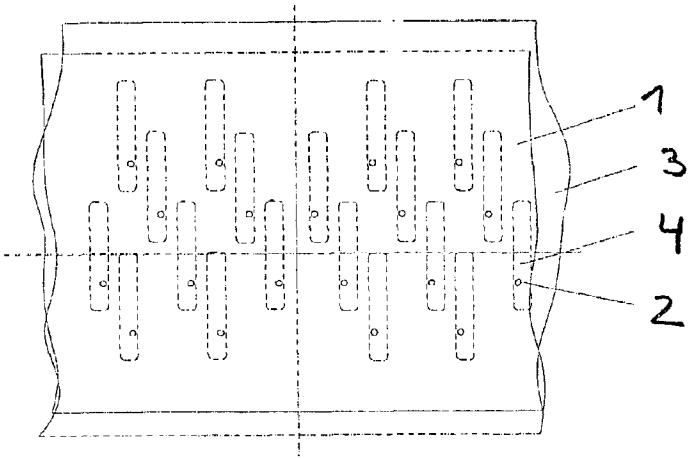
FIG. 10 shows the arrangement of the turner bar of a third embodiment with wider slots in the inner tube.

FIGS. 10 to 12 show an embodiment with only one inner tube, where the slots 4 are formed wider than the diameters of the holes 2. In the completely open state, the holes are assigned to the slots in such a way that each hole is positioned on the inner side of the slot towards the middle of the turner bar. This makes it possible to close one half of the turner bar or the other by the axial displacements indicated by the arrows in FIGS. 11 and 12, so that production can be carried out with a half web.

Figures 13A, 13B, 13C:
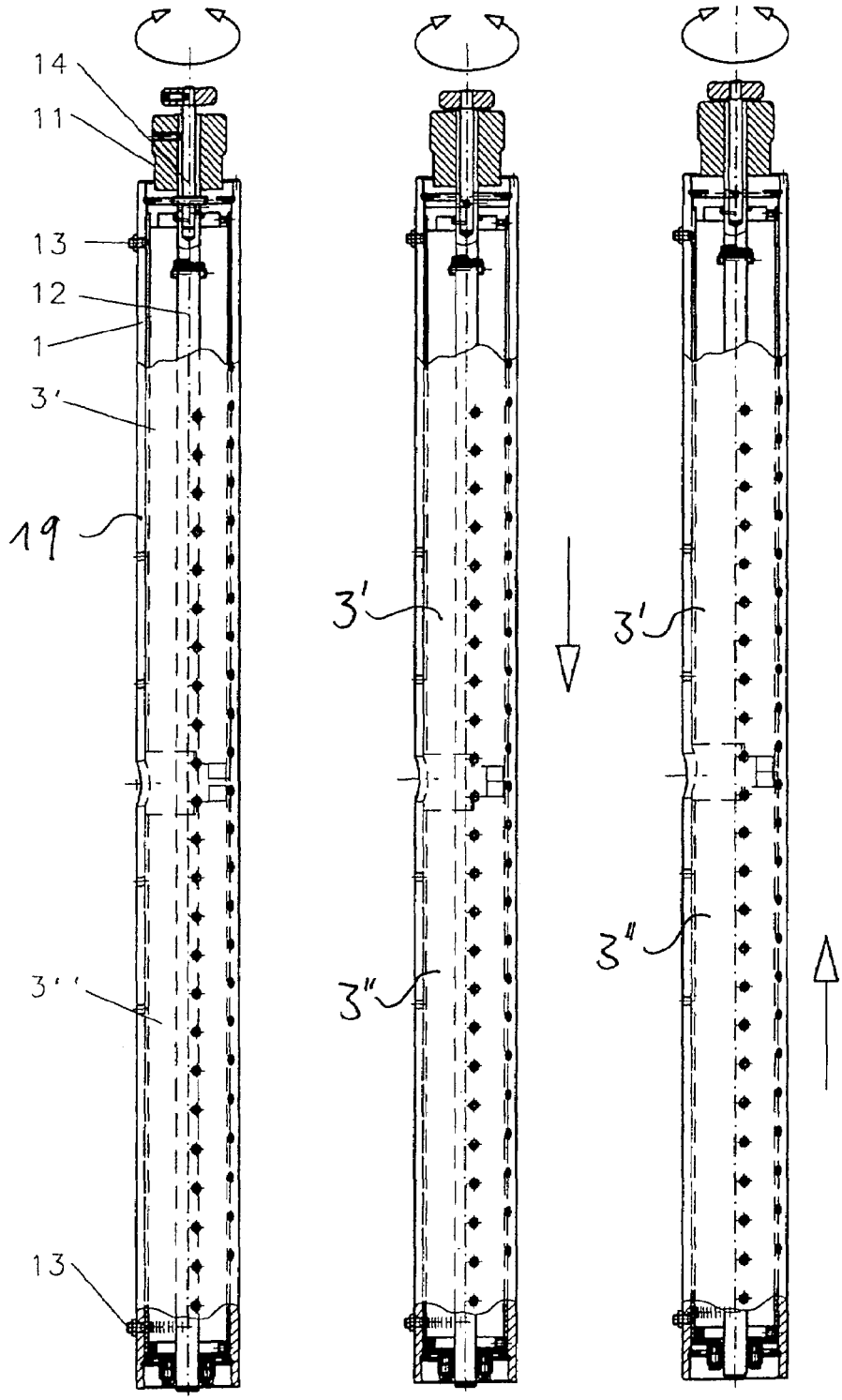

FIG. 13A shows the adjusting mechanism for the axial and rotary adjustment of the inner tubes 3', 3" relative to the outer tube 19. The rotary adjustment is made by a rotary knob 11, which is connected with a shaft 12 for rotationally driving the two inner tubes 3', 3". The rotary knob 11 has a position indicator (not shown). The drawing also shows locking elements 13 for locking the inner tubes 3', 3" in place in the rotational and axial direction. The inner tubes 3', 3" are axially adjusted by an axially displaceable adjusting element 14 with suitable means for locking the tubes in place.

In the position of FIG. 13A, the two inner tubes 3', 3" are positioned in such a way that a substrate web can be run over the turner bar in the middle, since in this position the inner tubes are apart, and thus all of the air discharge holes 2, 4, which are adjusted to a certain width, are open. In the position of 13B, the inner tube 3' is axially displaced towards the middle, and thus the air discharge holes in the half of the turner bar above the inner tube 3' are closed. In the position of FIG. 13C, the inner tube 3" is displaced towards the middle by connecting adjusting elements in the turner bar, and the inner tube 3' is once again in its original position (see FIG. 13A). The inner tube 3" is thus axially displaced with respect to its original position, and thus the air discharge holes in the half of the turner bar above the inner tube 3" are closed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A turner bar for deflecting a substrate web in a rotary press in several web running directions, said turner bar comprising:

an longitudinally extending outer tube having a cylindrical surface provided with outer air discharge holes for providing an air cushion between the cylindrical surface and the web, wherein the air discharge holes in the outer tube are formed as bores;

at least one longitudinally extending inner tube received concentrically with said outer tube and having a cylindrical surface provided with inner air discharge holes, wherein at least some of the air discharge holes in the at least one inner tube are formed as slots extending in a circumferential direction of said cylindrical surface and perpendicular to the longitudinal direction of the at least inner tube, and wherein the circumferential length of said slots in the at least one inner tube increase toward the axial middle of the turner bar so that slots being positioned in an axially middle section of the at least one inner tube have a larger circumferential length than slots being positioned in an axially outer section of the inner tube, wherein the at least one inner tube can be moved both rotationally and axially relative to the outer tube to change the relative position of the inner air discharge holes with respect to the outer air discharge holes to close the outer air discharge holes not needed for said air cushion.

2. The turner bar of claim 1 wherein the inner air discharge holes are positioned with respect to the outer air discharge holes so that, when the web running direction is changed, the outer air discharge holes not needed for the air cushion can be closed off by the relative movement of the tubes.

3. The turner bar of claim 1 wherein the inner air discharge holes are positioned with respect to the outer air discharge holes so that, the air cushion can be closed off by relative movement of the tubes.

4. The turner bar of claim 1 wherein the inner air discharge holes are positioned with respect to the outer air discharge holes so that the outer air discharge holes toward an end of the turner bar can be closed off by relative movement of the tubes.

5. The turner bar of claim 4 comprising the at least one inner tube and a second inner tube, wherein at least one of said inner tubes can be moved relative to the outer tube so that the outer air discharge holes for a corresponding half of the turner bar can be closed off.

6. The turner bar of claim 1 further comprising a holder which can hold the turner bar on either of two web running directions.

7. The turner bar of claim 1 further comprising one of an electric and a pneumatic drive for at least one of changing the position of the turner bar and moving the at least one inner tube relative to the outer tube.

8. The turner bar of claim 1 wherein a first relative position of the inner air discharge holes with respect to the outer air discharge holes is achieved by moving the at least one inner tube rotationally with respect to the outer tube, and a second relative position of the inner air discharge holes with respect to the outer air discharge holes is achieved by moving the at least one inner tube axially with respect to the outer tube.

* * * * *